US006250222B1

(12) United States Patent
Verlinden et al.

(10) Patent No.: US 6,250,222 B1
(45) Date of Patent: Jun. 26, 2001

(54) APPARATUS FOR THE CONTINUOUS TREATMENT OF SHEET MATERIAL UNDER REDUCED PRESSURE

(75) Inventors: Bartholomeus Verlinden, Tongeren; Bart Verhoest, Niel, both of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/387,971

(22) Filed: Sep. 1, 1999

Related U.S. Application Data

(60) Provisional application No. 60/113,336, filed on Dec. 22, 1998.

(30) Foreign Application Priority Data

Sep. 22, 1998 (EP) ..... 98203263

(51) Int. Cl.[7] ..... B41F 13/34

(52) U.S. Cl. ..... 101/375; 101/376

(58) Field of Search ..... 101/375, 376, 101/379; 427/172, 294, 295, 296; 118/718, 719, 720, 733

(56) References Cited

U.S. PATENT DOCUMENTS

| | | | | |
|---|---|---|---|---|
| 2,989,026 | * | 6/1961 | Gardner et al. | 118/718 |
| 3,158,507 | * | 11/1964 | Alexander | 118/718 |
| 4,777,557 | * | 10/1988 | Ahlbrandt | 361/225 |
| 5,000,114 | * | 3/1991 | Yanagi et al. | 118/733 |
| 5,314,539 | * | 5/1994 | Brown et al. | 118/718 |
| 5,842,855 | * | 12/1998 | Nakamura | 432/242 |

FOREIGN PATENT DOCUMENTS

| | | |
|---|---|---|
| 291952 | 5/1988 | (EP) . |
| 337369 | 10/1989 | (EP) . |
| 384041 | 8/1990 | (EP) . |
| 668370 | 9/1995 | (EP) . |
| 2084264 | 7/1981 | (GB) . |
| 9117561 | 11/1991 | (WO) . |

OTHER PUBLICATIONS

EP Patent Application 93/202862 (EP 0 647 882 A1).
EP Patent Application 97/201820 (EP 0 886 268 A1).

* cited by examiner

*Primary Examiner*—John S. Hilten
*Assistant Examiner*—Anthony H. Nguyen
(74) *Attorney, Agent, or Firm*—Baker Botts L.L.P.

(57) ABSTRACT

The apparatus comprises a housing (12) defining one or more treatment cells (14, 16, 18) having a sheet material path (20) extending therethrough from an entrance (22) to an exit (24). The entrance (22) and exit (24) are each closed by a respective drive roller (26) in contact with a reaction surface (28, 50) to define a nip (29) therebetween through which the sheet material path (20) extends. Rotatable sealing means (30) seal each drive roller (26) to the housing (12). A reduced pressure is established within the treatment cell (14, 16, 18). The continuous treatment of sheet materials can be carried out under reduced pressure, in a convenient and reliable manner.

14 Claims, 3 Drawing Sheets

APPARATUS FOR THE CONTINUOUS TREATMENT OF SHEET MATERIAL UNDER REDUCED PRESSURE

The application claims the benefit of U.S. Provisional Application No. 60/113,336 filed Dec. 22, 1998.

DESCRIPTION

FIELD OF THE INVENTION

This invention relates to an apparatus for the continuous treatment of sheet material under reduced pressure, particularly for the low pressure processing of photographic sheet material, such as X-ray film, pre-sensitised plates, graphic art film and paper, and offset plates.

BACKGROUND OF INVENTION

A number of processes are known which take place under conditions of reduced pressure. Examples include plasma cleaning, sputtering and vaporising. The material to be treated is often in the form of a sheet.

In International patent specification WO 91/17561 (Eastman Kodak) an apparatus for the plasma treatment of material in continuous form under vacuum is described. The apparatus comprises a housing defining a treatment cell having a sheet material path extending therethrough from an entrance to an exit, the entrance and exit each being closed by a roller pair. A vacuum is applied to the treatment cell.

The sealing of the rollers to the housing is an important feature if desirable consistent conditions of reduced pressure in the treatment cell are to be achieved. In the apparatus described in W091/17561, the rollers are sealed to the housing by the use of fixed sealing members. We have found that the use of fixed sealing members is often unsatisfactory, leading to undesirable leakages.

In European patent specification EP 0 384 041-A, (Agfa-Gevaert NV), a process is described for the coating of a web support under vacuum conditions with a layer of vapour depositable material followed by the lamination of the coated material with a protective organic resin layer.

Although the process described operates satisfactorily, the apparatus used requires both the vapour deposition and the lamination to take place in the same vacuum chamber. This chamber is therefore of a considerable volume, requiring the consumption of significant energy and time during start-up. Furthermore, once a batch of web support has been so coated and laminated, it can only be removed by releasing the vacuum to enable the chamber to be opened. Time and energy is therefore repeatedly wasted in shut-down and start-up of the apparatus.

OBJECTS OF INVENTION

It is an object of the present invention to provide an apparatus in which the continuous treatment of sheet materials can be carried out under reduced pressure, in a convenient and reliable manner.

SUMMARY OF THE INVENTION

We have discovered that this objective and other useful benefits may be achieved wherein the rollers closing the entrance and exit are drive rollers and rotatable sealing means are provided for sealing each drive roller to the housing.

According to the invention there is provided an apparatus for the continuous treatment of sheet material under reduced pressure, comprising a housing defining a treatment cell having a sheet material path extending therethrough from a sheet material entrance to a sheet material exit, the entrance and exit each being closed by a respective path-defining roller in contact with a reaction surface to define a nip therebetween through which the sheet material path extends, and means for establishing a reduced pressure within the treatment cell, characterised in that each said path-defining roller is a drive roller and rotatable sealing means are provided for sealing each drive roller to the housing.

The apparatus according to the invention provides the possibility for continuous processing, overcoming the time and energy wasted in start-up and shut-down in a non-continuous process.

Furthermore, the construction of the apparatus according to the invention enables the treatment cell volume to be reduced since other processing steps, not relying on the use of reduced pressure, can take place outside the treatment cell. By the use of a treatment cell of reduced volume, the start-up time and energy requirement is reduced.

By the use of a rotatable sealing member in place of a stationary sealing member, the torque which needs to be applied to the drive roller can be significantly reduced. This reduces the power needed by the processor, reduces wear on the drive roller, reduces the mechanical deformation thereof and thereby extends the expected life time. This construction also improves the control of pressure distribution over the sheet material.

Each drive roller may comprise a rigid core provided with a covering of elastomeric material, although it is possible for the drive roller to be elastomeric throughout its cross-section. By the term "core" we mean an axially inner member, which is usually cylindrical and which is relatively rigid compared to the elastomeric material covering. The core may be solid or hollow. Usually, drive to the roller will be applied to the core. In a preferred embodiment, each of the ends of the elastomeric material covering are in sealing contact with a surface of end plates of the housing. The surface of each end plate may be formed of, or coated with, a low friction material such as polished metal, or polytetrafluoroethylene. The elastomeric material may extend beyond the ends of the core to define a space into which the elastomeric material of the covering may be deformed as a result of a sealing force between the covering and the end plate. Such an arrangement improves the sealing between the drive roller and the end plate. In a preferred embodiment, the roller comprises an inner layer of elastomeric material having a relatively low hardness, and an outer region of elastomeric material having a relatively high hardness positioned over the inner layer. Such a roller minimises leakage as the sheet material passes through the nip without damage to the sheet material while enabling the roller to successfully function as a drive roller. Alternatively, the elastomeric material of the inner layer has substantially the same hardness as the elastomeric material of the outer layer, and the outer layer is doped with a surface modifying material.

In a preferred embodiment, each roller comprises a main body member, a shaft fixed to the main body member and extending from one end thereof. An end member is positioned in contact with the main body member, the end member comprising wear resistant material for face-to-face sliding contact with an end plate of the housing and being mounted on the shaft in a replaceable manner. The shaft may be fixed to the main body member by bonding the roller core to an end piece of the roller shaft by glue positioned in a bonding chamber between bonding surfaces of the core and the shaft end piece. The bonding chamber may be provided with an entrance and an exit, enabling the roller to be fabricated by introducing liquid glue into the bonding chamber while allowing air to be expelled through the exit until the bonding chamber is at least substantially full of the glue.

As the sheet material leaves the treatment cell, in view of the nature of elastomeric material, it is in fact impossible to totally eliminate any gap between the drive roller surface at the edges of the sheet material as it passes through the nip. It is desirable that the drive roller surface be in contact with the reaction surface within as short a distance as possible from the edges of the sheet material i.e. that the size of the leak zone should be minimised. It is important however that the force between the drive roller and the reaction surface is sufficient to prevent leakage when no sheet material is passing through. However, the force must not be so high as to risk physical damage to the sheet material as it passes through the nip.

The objective of a minimum leak zone referred to above can be achieved if the ratio of the diameter of the drive roller to its length is above a critical limit. In particular, the drive roller preferably comprises a rigid core carrying a covering of elastomeric material, the ratio ($\phi$/L) of the maximum diameter ($\phi$) of the elastomeric material covering to the length (L) thereof being at least 0.012, most preferably between 0.03 and 0.06.

The elastomeric material covering preferably has a thickness of between 1 mm and 30 mm. The elastomeric material may be selected from ethylene/propylene/diene terpolymers (EPDM), silicone rubber, polyurethane, thermoplastic rubber such as Santoprene (Trade Mark for polypropylene/EPDM rubber), styrene-butyl rubber, nitrile-butyl rubber, PFA and Fluor-Latex (FLC) materials. The hardness of the elastomeric material may be between 15 Shore (A) and 90 Shore (A), as measured on the roller surface. Where the elastomeric material comprises an inner layer of relatively low hardness and an outer layer of relatively high hardness, the inner layer should have a hardness of less than 50 Shore A, while the outer layer should have a hardness of more than 25 Shore A. At least a portion of the outer region of elastomeric material may contain a wear resistant material, such as potassium titanate whiskers.

In one embodiment, the diameter ($\phi$) of the elastomeric material covering is constant along the length of the drive roller. Alternatively the drive roller may have a radial dimension profile which varies along the length thereof. In the latter case, the diameter ($\phi$) in the expression $\phi$/L is the maximum diameter. Alternatively or additionally, the diameter of the core varies along the length thereof. Ideally, the radial dimension profile of such a drive roller is such in relation to the force applied by the drive roller to sheet material passing through the nip as to be substantially even over the width thereof. Where the elastomeric covering of the drive roller comprises distinct intermediate and outer regions, the outer region may have a thickness which decreases towards the ends of the roller and the intermediate region having a thickness which increases towards each end of the roller.

Preferably, the core has a flexural E-modulus of between 50 GPa and 300 GPa. Suitable materials for the rigid core include metals, such as stainless steel, non-ferrous alloys, titanium, aluminium or a composite material, for example comprising fibres and a resin matrix.

In one embodiment, the core is hollow. Alternatively the core may be solid.

Each drive roller may be biased towards the reaction surface by a variety of methods, for example by making use of the intrinsic elasticity of the elastomeric material, by the use of fixed drive roller bearings. Alternatively, use may be made of resilient means such as springs which act on the ends of the drive roller shafts.

The springs may be replaced by alternative equivalent compression means, such as e.g. a pneumatic or a hydraulic cylinder.

The end plates are preferably biased against the end faces of the drive rollers with a force of from 2 to 500 g/cm of contact between the end plate and the end face of the roller, measured on the surface of the roller. The end plates may be urged against the end faces of the drive rollers by springs so shaped to ensure the desired location of the contact line between the end plates and the end faces of the rollers. Alternatively the elastomeric material covering of the drive rollers is somewhat oversized, the necessary spring force then being derived from the elasticity of the elastomeric material itself.

The rotatable sealing means preferably comprises at least one sealing roller. Each sealing roller preferably contacts its associated drive roller on the low pressure side of a plane on which the nip and the axis of the drive roller lie. Each drive roller may be provided with at least two sealing rollers.

The sealing roller may have a diameter less than that of the drive roller. For example, the sealing roller may have a diameter which is from one tenth to one third of the diameter of the drive roller, thereby enabling the torque which needs to be applied to be further reduced. The sealing roller preferably extends in a straight line parallel to the associated drive roller axis.

The sealing roller may be formed of a material having a coefficient of friction (as measured against stainless steel) of less than 0.3, preferably from 0.05 to 0.2, for example highly polished metals such as steel, especially Cr—Ni steel and Cr—Ni—Mo steel, a metal coated with Ni—PTFE (NIFLOR—Trade Mark), a polymer material such as PTFE (poly tetra fluoro ethylene), POM (polyoxymethylene), HDPE (high density polyethylene), UHMPE (ultra high molecular weight polyethylene), polyurethane, PA (polyamide), PBT (polybutyl terephthalate) and mixtures and composites thereof.

In a preferred embodiment, the sealing roller is carried by a longitudinal bearing, secured within the housing.

The longitudinal bearing may have face-to-face contact with the sealing roller over at least two contact regions, which are located, for example, at from ±120° to 150° relative to the line joining the centres of a drive roller and its associated sealing roller, such as ±135° to that line. The width of contact between a sealing roller and its associated longitudinal bearing in each contact region is, for example, from 20° to 40° of the circumference of the sealing roller, which in the case of a sealing roller having a diameter of 8 mm may be about 2 mm per contact region.

The surface of the sealing roller opposite to the drive roller may be in contact with one or more fixed sealing members carried in, or formed as part of, the longitudinal bearing. The fixed sealing member may, for example, be retained within a longitudinal groove formed in the longitudinal bearing. The fixed sealing member may have a symmetrical profile section but a non-symmetrical profile section is also possible, its shape and resilience taking into account the static and dynamic pneumatic pressures in the cell and the interacting forces with the sealing roller, allowing for the fact that the drive roller and the sealing roller may be adapted to rotate in both directions. The fixed sealing member which is carried in, or formed as part of, the longitudinal bearing exerts a pressure on the sealing roller.

To reduce friction at this point, the contact surface between the fixed sealing member and the sealing roller is kept to a minimum. It is also desirable to establish a sealing pressure between the drive roller and the sealing roller. The absolute force applied by the drive roller to the sealing roller should be greater than the absolute force exerted by the fixed sealing member on the sealing roller to ensure that the sealing roller touches the bearing surfaces of the longitudinal bearing. This enables the absolute force exerted by the sealing roller on the bearing surfaces to be reduced to a minimum thereby reducing the friction at this point. The pressure exerted by the drive roller on the sealing roller may be derived from the mounting of the sealing roller or simply from compression of the elastomeric material covering of the associated drive roller or from spring forces exerted on the drive roller.

It is preferred that the end faces of the sealing roller and fixed sealing member extend beyond the end faces of the elastomeric part of the drive roller. In this way the sealing function is less dependant on tolerances and differential thermal expansion of these components and their thermal expansion relative to the drive roller, more precisely between the end faces of the drive roller. That is, it is preferred that the stationary sealing member is longer than the associated drive roller, and further that the contact surfaces of the longitudinal bearing with the sealing roller are shorter than the associated drive roller.

The ends of the sealing roller may be in contact in a leak-free manner with the end plates. For example, the end of the sealing roller passes into a blind aperture in the end plate. In an alternative embodiment, the end of the sealing roller is located in an open aperture in the end plate, this aperture being provided with a sealing ring, or other sealing member, formed for example of sintered PTFE, to prevent leakage therethrough.

It is important that the sealing rollers are retained in these end plates in a leak-free manner. A line contact between the sealing rollers and the end plates is preferred to a surface-to-surface contact. In one embodiment, the sealing ring surrounds the end of the sealing roller and is urged into line-to-surface sealing engagement with the surface of the sealing roller by a spring. We have found that line contact between the sealing roller and the end plates need not extend circumferentially completely around the sealing roller, and indeed there is an advantage in this line contact extending only part way around the sealing roller, but on the low pressure side thereof.

This construction makes the tolerances to which the sealing roller and the end plates are constructed less critical. It is preferred to use a sealing ring which is so constructed as to compensate for the wear thereof. This can be achieved by forming the sealing ring with a frusto-conical inner surface and by the provision of a spring force which acts in a direction to feed sealing material towards the wear surface.

We prefer to use a material for the sealing ring which has good "creeping" characteristics to compensate for the wear under spring pressure, such as sintered PTFE.

In an alternative embodiment, end portions of the sealing roller are formed of an elastomeric material, such as natural or synthetic rubber, and these end portions press against the end plates in a leak-free manner.

The drive mechanism for the drive rollers may, for example, include drive wheels mounted on drive roller shafts which pass through a wall of the housing and a common drive belt in engagement with these drive wheels.

The treatment cell may be provided with means for the supply of a treatment agent for the sheet material. These treatment agents may be generated within the cell itself or may be supplied, usually in the form of a gas or vapour, by the provision of suitable pumps, valves and feed lines.

One or more of the cells of the apparatus may include additional features if desired. Cleaning means may be provided for acting upon the drive rollers to remove debris therefrom, as described in European patent application EP 93202862 (Agfa-Gevaert NV), filed Oct. 11, 1993. Additional rollers, such as a roller pair or staggered rollers may be provided for transporting the sheet material through the apparatus, and these rollers will normally be drive rollers. Guide means may be included for guiding the passage of the sheet material through the apparatus. The apparatus may further comprise a sheet contacting member, such as a rotatable brush, positioned between the sheet material entrance and the sheet material exit. Such a brush can be used to remove debris from the sheet material, such as from a printing plate, to be sucked away by the reduced pressure applied to the treatment cell. Heating means may be provided in one or more cells so that the cell becomes a sheet material drying unit. Any combination of these additional features is also possible.

The sheet material may be in the form of cut sheets, or in the form of a web. Usually the sheet material will be flexible, but for less flexible materials it is an advantage if the sheet material path through the apparatus is substantially straight. However, in general, the sheet material path through the apparatus may be straight, curved or even serpentine. Particularly in the case of a curved or serpentine sheet material path, a guide surface may be provided in the treatment cell between the entrance and the exit to support the sheet material as it passes along the sheet material path. This guide surface may be the surface of a stationary member, such as a guide plate, or of a movable member such as a guide roller.

Sheet materials which can be treated include those formed of plastics materials, metals, glass, paper and other fibrous materials.

In a preferred embodiment, at least three cells are arranged in the sequence of an entry cell, at least one intermediate cell and an exit cell, the pressure in the one or more intermediate cells being lower than the pressure in the entry and exit cells. Each cell of the apparatus may be of modular construction and be provided with means to enable the cell to be mounted directly adjacent an identical or similar other cell in a closed manner. Alternatively, the apparatus may take an integral form or semi-integral form. The term "semi-integral form" we intend to include an apparatus which is divided by a plane passing through all the cells in the apparatus, particularly the plane of the sheet material path, enabling the apparatus to be opened-up for servicing purposes, in particular to enable easy access to the drive rollers.

Means may be provided for separating each drive roller from the reaction surface for the purposes of maintenance. For example, the drive roller may be supported by bearings carried by eccentric sleeves which are stationary in the closed position, with means for partly rotating the sleeves thereby to withdraw the roller from the reaction surface into an open position.

In one embodiment, the drive rollers constitute main drive rollers and the reaction surface is constituted by the surface of a further drive roller associated one with each of the main drive rollers. The further drive rollers may also be sealed to the housing by rotatable sealing means, such as a sealing roller. Each further drive roller may comprise a rigid core provided with a covering of elastomeric material.

In an alternative embodiment, the reaction surface is constituted by the surface of a drum in contact with both the drive rollers. This arrangement is beneficial for computer-to-press processes. The apparatus may further include means for lifting the housing, including the drive rollers and the rotatable sealing means, away from the surface of the drum when not in use. The drum may, for example, be the printing drum of an offset printing machine.

The apparatus according to the invention can be used to carry out a number of processes. For example, thin metal layers, such as bismuth, can be applied to transparent organic resin supports as described in EP 0 384 041 referred to above or in European patent application 97201820.4 (Agfa-Gevaert NV) filed Jun. 18, 1997, to form a heat mode recording element. The apparatus may also be used for the plasma treatment of continuous material as described in WO 91/17561 referred to above, for continuously treating the surface of a plastic moulding under vacuum as described in British patent specification GB 2084264 (Hitachi Ltd.), for the surface treatment of a thin film support under vacuum as described in European patent specification EP 0 668 370-A (Fuji Photo Film), or dry plating of sheet metals as described in European patent specification EP 0 291 952A (Kawasaki Steel).

DETAILED DESCRIPTION OF THE INVENTION

The invention will be described by the following illustrative embodiments with reference to the accompanying drawings without the intention to limit the invention thereto, and in which.

Figure 1:
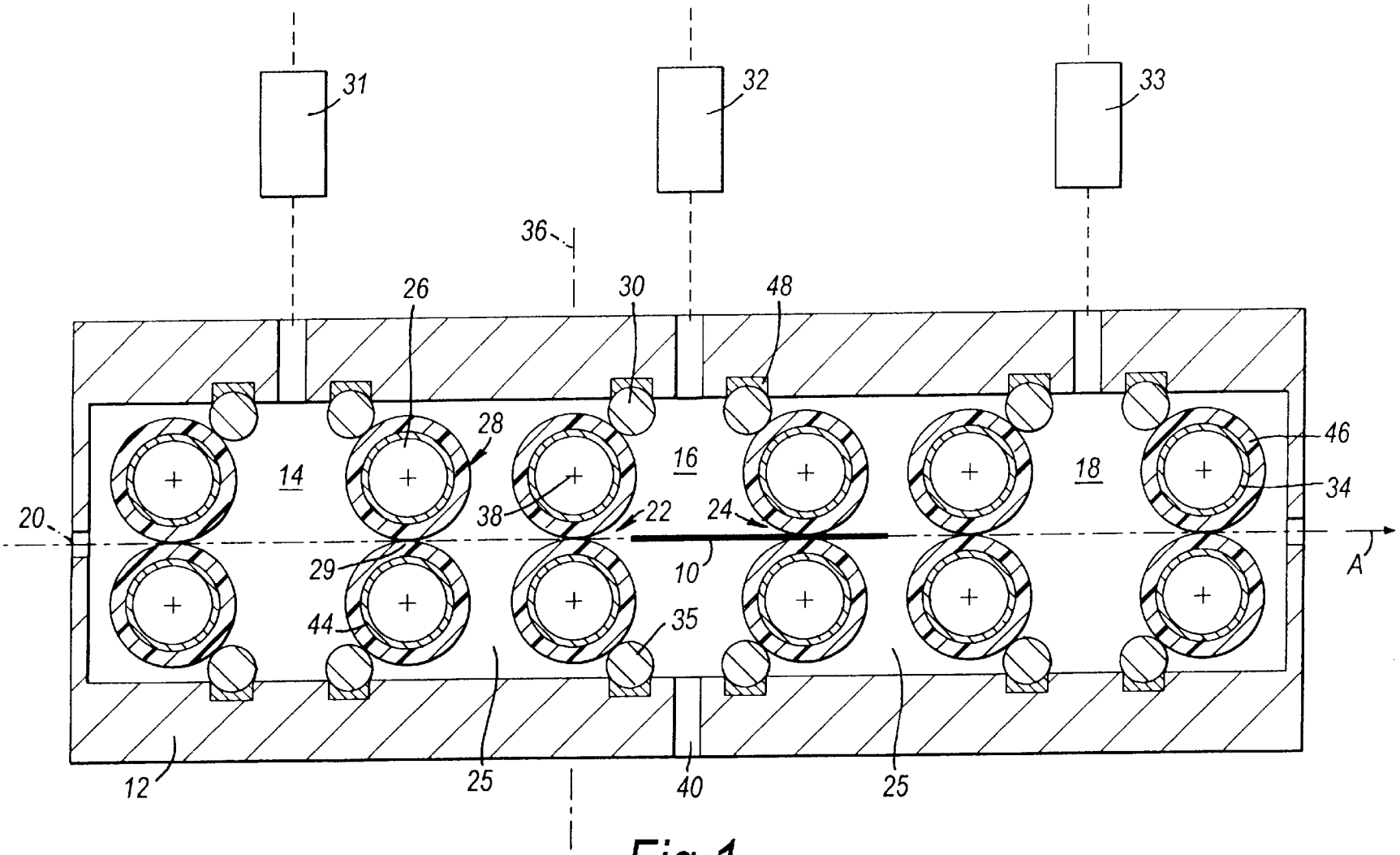
FIG. 1 shows schematically a cross-section of an apparatus according to a first embodiment of the invention.

As shown in FIG. 1, an apparatus for the continuous treatment of sheet material 10 under reduced pressure, comprises a housing 12 defining a sequence of treatment cells 14, 16, 18. The three treatment cells 14, 16, 18 are arranged in a sequence of an entry cell 14, an intermediate cell 16 and an exit cell 18.

Each treatment cell has a substantially straight sheet material path 20 extending therethrough from a sheet material entrance 22 to a sheet material exit 24.

Each entrance 22 and exit 24 is closed by a main drive roller 26 in contact with the surface 28 of a further drive roller 44 to define a nip 29 therebetween through which the sheet material path 20 extends. Each drive roller 26, 44 comprises a rigid core 34 provided with a covering 46 of elastomeric material and is driven by a drive mechanism not shown, to drive the sheet material 10 along the path 20 in the direction of the arrow A.

The apparatus includes pumps 31, 32, 33 for establishing reduced pressure within the treatment cells 14, 16, 18. The pressure in the intermediate cell 16 is lower than the pressure in the entry and exit cells 14, 18.

The intermediate treatment cell 16 is provided with an inlet 40 for the supply of a treatment agent for the sheet material 10, for example for the supply of a source of bismuth for the formation of heat mode recording elements comprising a thin bismuth recording layer on a substrate in sheet form.

Each drive roller 26 is in sealing contact along its length, with a rotatable sealing roller 30 formed for example of hardened or PTFE-coated stainless steel carried by fixed longitudinal bearings 48, formed, for example, of high density polyethylene, mounted on the housing 12. The sealing roller 30 contacts its associated drive roller 26 on the low pressure side of a plane 36 on which the nip 29 and the axis 38 of the drive roller 26 lie.

Figure 3:
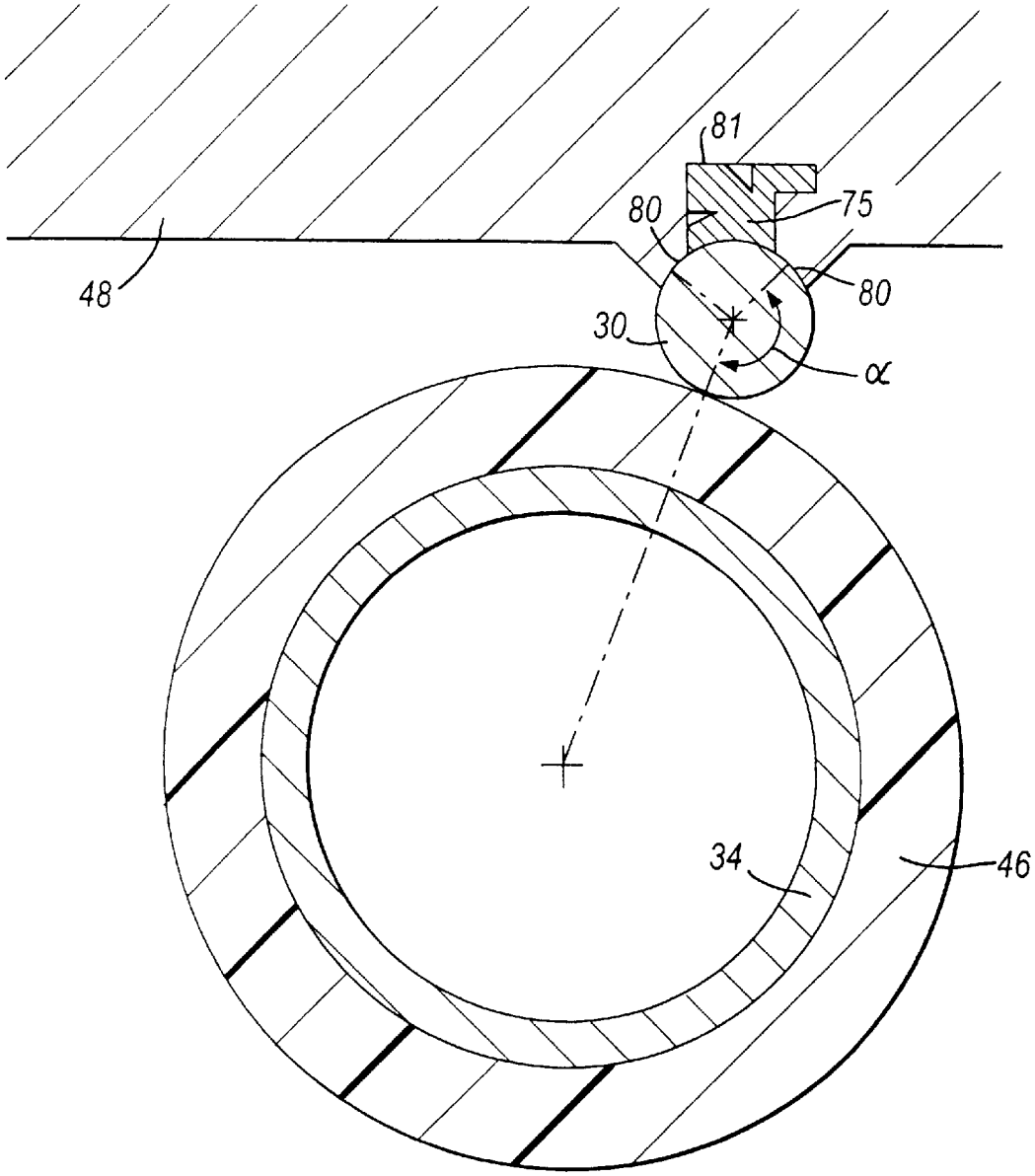
FIG. 3 shows in enlarged detail of part of the apparatus shown in FIG. 1.

As can be seen in FIG. 3, the longitudinal bearing 48 is in face-to-face contact with the sealing roller over two contact regions 80, which are positioned one on either side of a groove 81 extending along the length of the longitudinal bearing 48, the contact regions 80 being located at an average angle $\alpha$ of 135° relative to the line joining the centres of a drive roller 26 and the sealing roller 30. The longitudinal bearing 48 is secured to the housing 12 of the cell, the low pressure being retained in the cell by the drive roller 26 and the sealing roller 30.

The further drive rollers 44 are similarly sealed to the housing 12 by sealing rollers 35, similar in construction to the sealing rollers 30.

Figure 2:
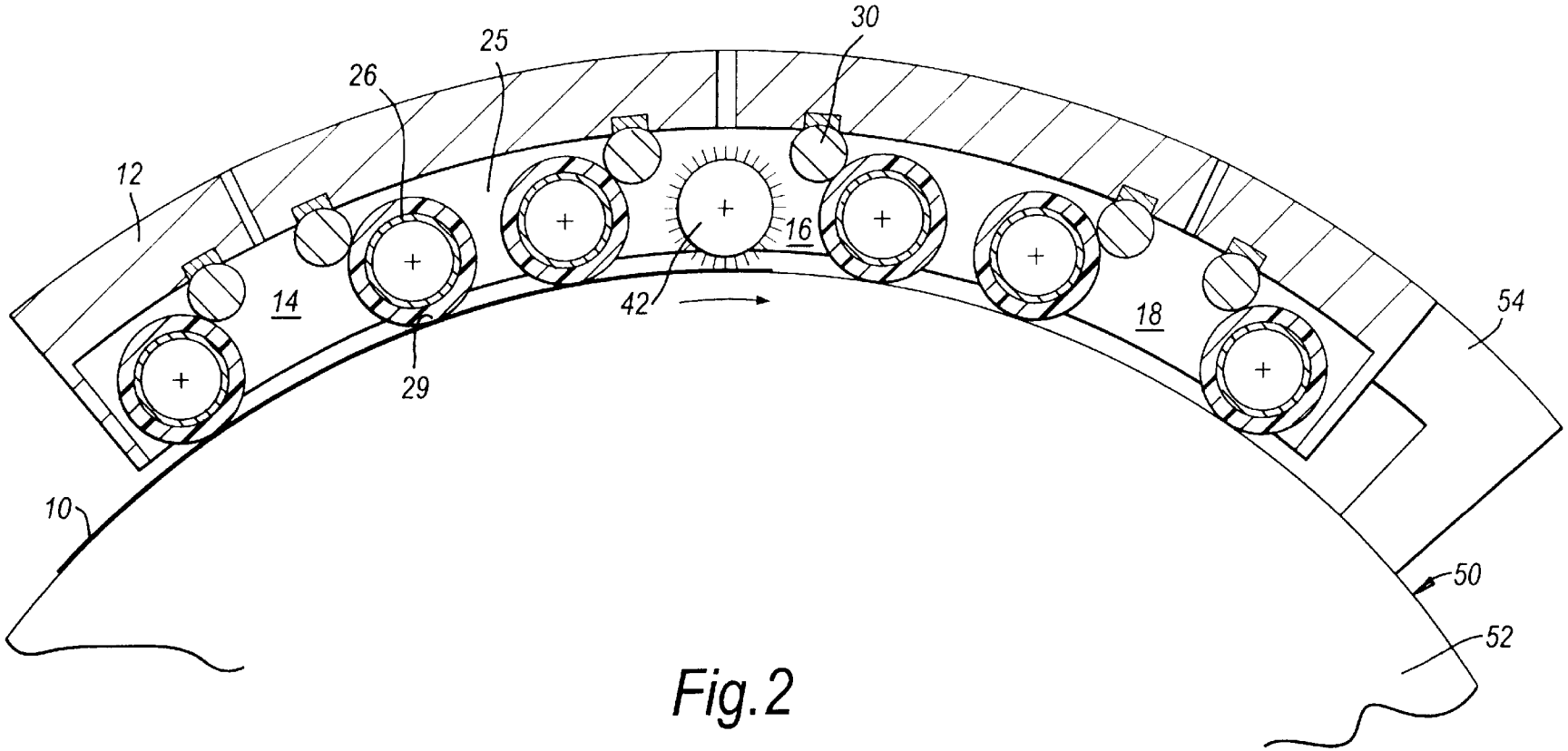
FIG. 2 shows schematically a cross-section of an apparatus according to a second embodiment of the invention.

In the embodiment shown in FIG. 2, where like features are indicated by like reference numbers, the drive rollers 26 are in contact with the surface 50 of a printing drum 52 of an offset printing machine. A pivoted support frame 54 is provided for lifting the housing 12, including the drive rollers 26 and the sealing rollers 30, away from the surface 50 of the drum 52 when not in use. In this embodiment, the intermediate treatment cell 16 is provided with a rotatable brush 42, positioned in the intermediate cell 16, between the sheet material entrance 22 and the sheet material exit 24, to contact the sheet 10 as it passes through the intermediate cell 16.

| Reference Number List | |
|---|---|
| sheet material 10 | axis 38 |
| housing 12 | inlet 40 |
| entry cell 14 | rotatable brush 42 |
| intermediate cell 16 | further drive roller 44 |
| exit cell 18 | covering 46 |
| path 20 | longitudinal bearings 48 |
| entrance 22 | surface 50 |
| exit 24 | printing drum 52 |
| chambers 25 | support frame 54 |
| main drive roller 26 | contact regions 80 |
| surface 28 | groove 81 |
| nip 29 | |
| sealing roller 30 | |
| sealing roller 35 | |
| pumps 31, 32, 33 | |
| core 34 | |
| plane 36 | |

What is claimed is:

1. An apparatus for the continuous treatment of sheet material, comprising:

a housing defining a treatment cell having a sheet material entrance, a sheet material exit, and a sheet material path, said sheet material path being defined by said sheet material entrance and said sheet material exit and extending through said treatment cell;

a plurality of path-defining rollers closing each said sheet material entrance and said sheet material exit and defining a nip at each said sheet material entrance and said sheet material exit through which said sheet material path extends, each said path-defining roller comprising a drive roller;

rotatable sealing means for sealing each said drive roller to said housing;

means for establishing a reduced pressure within said treatment cell;

a drum surface constituting a reaction surface, said drum surface being in contact with said plurality of path-defining rollers; and means for lifting said housing, including said drive rollers and said rotatable sealing means, away from said drum surface when not in use.

2. An apparatus according to claim 1, wherein said drum surface is a printing drum surface of an offset printing machine.

3. An apparatus according to claim 1, wherein each said drive roller comprises a rigid core provided with a covering of elastomeric material.

4. An apparatus according to claim 1, wherein said rotatable sealing means comprises at least one sealing roller and wherein at least one of said sealing rollers is associated with one of said drive rollers and is disposed on the low pressure side of one of said drive rollers.

5. An apparatus according to claim 1, wherein said treatment cell is provided with means for the supply of a treatment agent for the sheet material.

6. An apparatus according to claim 1, further comprising a sheet contacting member positioned between said sheet material entrance and said sheet material exit.

7. An apparatus according to claim 1, wherein at least three said treatment cells are arranged in a sequence of an entry cell, at least one intermediate cell and an exit cell, the pressure in said one or more intermediate cells being lower than the pressure in said entry and exit cells.

8. An apparatus according to claim 1, wherein at least one of said drive rollers further comprise a main drive roller and a drive roller surface, and wherein said reaction surface is in contact with said drive roller surface.

9. An apparatus according to claim 1, wherein at least one of said drive rollers has a length L and comprises a rigid core and an elastomeric covering having a diameter d and wherein a ratio of d/L is at least 0.03 and not more than 0.06.

10. An apparatus according to claim 1, wherein at least one of said drive rollers has a length L and comprises a rigid core and an elastomeric covering having a diameter d wherein said diameter varies along said length such that a force applied by at least one of said drive rollers to said sheet material is substantially even along said length.

11. An apparatus according to claim 1, wherein at least one of said drive rollers has a length L and comprises a rigid core having a diameter d and an elastomeric covering having a thickness t wherein said diameter and said thickness vary along said length such that a force applied by at least one of said drive rollers to said sheet material is substantially even along said length.

12. An apparatus according to claim 1, wherein a diameter of at least one of said sealing rollers is smaller than a diameter of at least one of said drive rollers.

13. An apparatus according to claim 1, further comprising a sheet contacting member, said sheet contacting member disposed between said sheet material entrance and said sheet material exit for removing debris from said sheet material.

14. An apparatus according to claim 13, further comprising a heating means within said treatment cell.

* * * * *